United States Patent [19]

Augsburger

[11] 4,267,624

[45] May 19, 1981

[54] METHOD OF PLACING MASK MOUNTING PINS IN A CRT FACEPLATE

[75] Inventor: William F. Augsburger, Pickerington, Ohio

[73] Assignee: Owens-Illinois, Inc., Toledo, Ohio

[21] Appl. No.: 86,862

[22] Filed: Oct. 22, 1979

[51] Int. Cl.[3] ..... H01J 9/18

[52] U.S. Cl. ..... 29/25.15; 29/25.13

[58] Field of Search ..... 29/25.13, 25.15

[56] References Cited

U.S. PATENT DOCUMENTS

| | | | |
|---|---|---|---|
| 3,482,286 | 12/1969 | Fassett et al. | 29/468 X |
| 3,701,185 | 10/1972 | Van Renssen | 29/25.13 |
| 4,058,875 | 11/1977 | Nubani et al. | 29/25.15 |

*Primary Examiner*—Richard B. Lazarus

*Attorney, Agent, or Firm*—David R. Birchall; Myron E. Click; David H. Wilson

[57] ABSTRACT

The disclosure relates to a cathode ray tube for colored television. A shadow mask is employed within the tube and is held in fixed position interiorly of the tube faceplate. The shadow mask is held in position by anchor pins positioned within the four corners of the faceplate. A method has been devised whereby the shadow mask is permitted a certain degree of flexibility, thus permitting the surface of the shadow mask to follow the curvature of the interior surface of the faceplate. The method encompasses fixing three of the shadow mask support points within the faceplate to define a reference plane, then gauging the distance from the established plane to the interior surface of the faceplate so that the fourth shadow mask support point can be positioned in its optimum position to minimize any errors in the distance between the surfaces of the shadow mask and the interior of the faceplate.

11 Claims, 3 Drawing Figures

METHOD OF PLACING MASK MOUNTING PINS IN A CRT FACEPLATE

BACKGROUND OF THE INVENTION

The present invention relates to cathode ray tubes in general, and more particularly, to tubes utilized in the colored television industry.

Colored or polychromatic television tubes employ a shadow mask that is suspended a short distance behind the interior surface of the tube faceplate where the various phosphors are positioned. In order to maintain the distance between the phosphor coated interior surface of the faceplate and the shadow mask, it has been common to fabricate the shadow mask with a heavy frame to minimize distortion and maintain the aforementioned distance better known as the "Q" distance. The shadow mask and its associated frame are held within the faceplate by suspending it from a series of pins or studs which are embedded within the interior glass wall of the faceplate flange.

Since the manufacture of the glass components of a television tube must be done at elevated temperatures, it is difficult to maintain precise dimensional tolerances on, for example, the interior surface of the tube faceplate. The grinding of the faceplate exterior is easily accomplished by various grinding techniques, however, because of the faceplate flanges, the grinding of the faceplate interior is quite difficult. Consequently, the interior of the faceplate retains essentially that configuration imparted upon it by the molds used in its creation. Also, there are certain manufacturing tolerances associated with the fabrication of the shadow mask, as well as certain dimensional changes caused by the cooling of the glass.

The present invention relates to an improvement in the positioning of a shadow mask within the television tube, particularly, television tubes that utilize the new concept of a flexible mask as distinguished from the more rigid masks employing a heavy frame. With the advent of a flexible mask, certain positioning techniques can be used which were not possible with the more rigid prior frames. The method of affixing the shadow mask within the television tube permits the faceplate assembly, including the shadow mask, to be easily and repeatedly installed and removed from its mounts while assuring a degree of accuracy not heretofore attainable.

DESCRIPTION OF THE PRIOR ART

The principle of a flexible shadow mask is disclosed in U.S. Pat. No. 3,986,072 which issued on Oct. 12, 1976. In U.S. Pat. No. 3,986,072 there is disclosed a television cathode ray tube in which the shadow mask has a certain degree of flexibility. The shadow mask does not utilize the heavy frame of prior shadow masks, but rather uses a four bar linkage system where each individual side of the shadow mask frame is rigid in itself, however, the entire shadow mask remains flexible because the individual side members are not rigidly affixed to one another as in a picture frame. Thus the four bar arrangement of the present invention, and as set forth in the prior art, provides a flexible sheet or shadow mask that is relatively stiff with respect to the minor and major axes of the television faceplate. Even as the corners of the shadow mask undergo movement toward and away from the interior surface of the faceplate, the points on the minor and major axes remain relatively stationary.

OBJECTS OF THE INVENTION

The main object of this invention is to provide a method for determining the accuracy of the position of a shadow mask within a cathode ray tube.

Another object of the present invention is to set forth a method for establishing where the faceplate can best be positioned to enhance the accuracy of dimensional distance between the shadow mask and the faceplate interior surface.

A further object of the present invention is to set forth a method of measuring the variance in distance between a plane established by at least three shadow mask mounting points and the interior surface of the faceplate, then comparing the distance readings with a mathematical model to select the ultimate position of the remaining shadow mask mounting point.

SUMMARY OF THE INVENTION

The present invention relates to an improved method of positioning a shadow mask within a television tube faceplate. Particularly, the method relates to a shadow mask which is lightweight and torsionally flexible.

In cathode ray tubes employing post deflection focus, the positioning of the shadow mask is not only important, but also the support structure for the shadow mask must lend itself to mounting and dismounting the shadow mask yet having the shadow mask always assuming the same position relative to the interior faceplate surface. It is also quite important to maintain certain tolerances or variations in the "Q" spacing, that is, the distance between the shadow mask and the interior surface of the faceplate where the phosphors of the three primary colors are set down in their respective geometric patterns.

Shadow masks are rigidly mounted within the television tube by attachment pins or more commonly referred to as studs. When the proper stud location has been ascertained, the stud is embedded into the interior wall of the flange of the faceplate. The stud is inserted into the glass by heating the glass locally then forcing the stud into it. Another system of stud insertion involves the use of R.F. energy whereby the metallic stud is heated until it incandesces, and then forcing it against the glass, thus softening the adjacent glass to the point where the stud can be easily embedded.

A plurality of studs are used to mount the shadow mask to the faceplate. Three stud locations, of course, define a plane and would in some instances suffice for adequate shadow mask mounting. The present inventive method utilizes four mounting studs.

The shadow mask can be formed from a single sheet of electrically conductive material such as cold-rolled steel. The sheet contains the prescribed apertures therein for selected passage of electrons emitted from the electron guns positioned in the neck portion of the television tube.

BRIEF DESCRIPTION OF THE DRAWING

The drawing provides a way in which the method of the present invention can best be understood. The invention, including additional object and advantages thereof, can be best understood by reference to the following description taken in connection with the accompanying drawing.

DESCRIPTION OF THE PREFERRED EMBODIMENT

Figure 1:
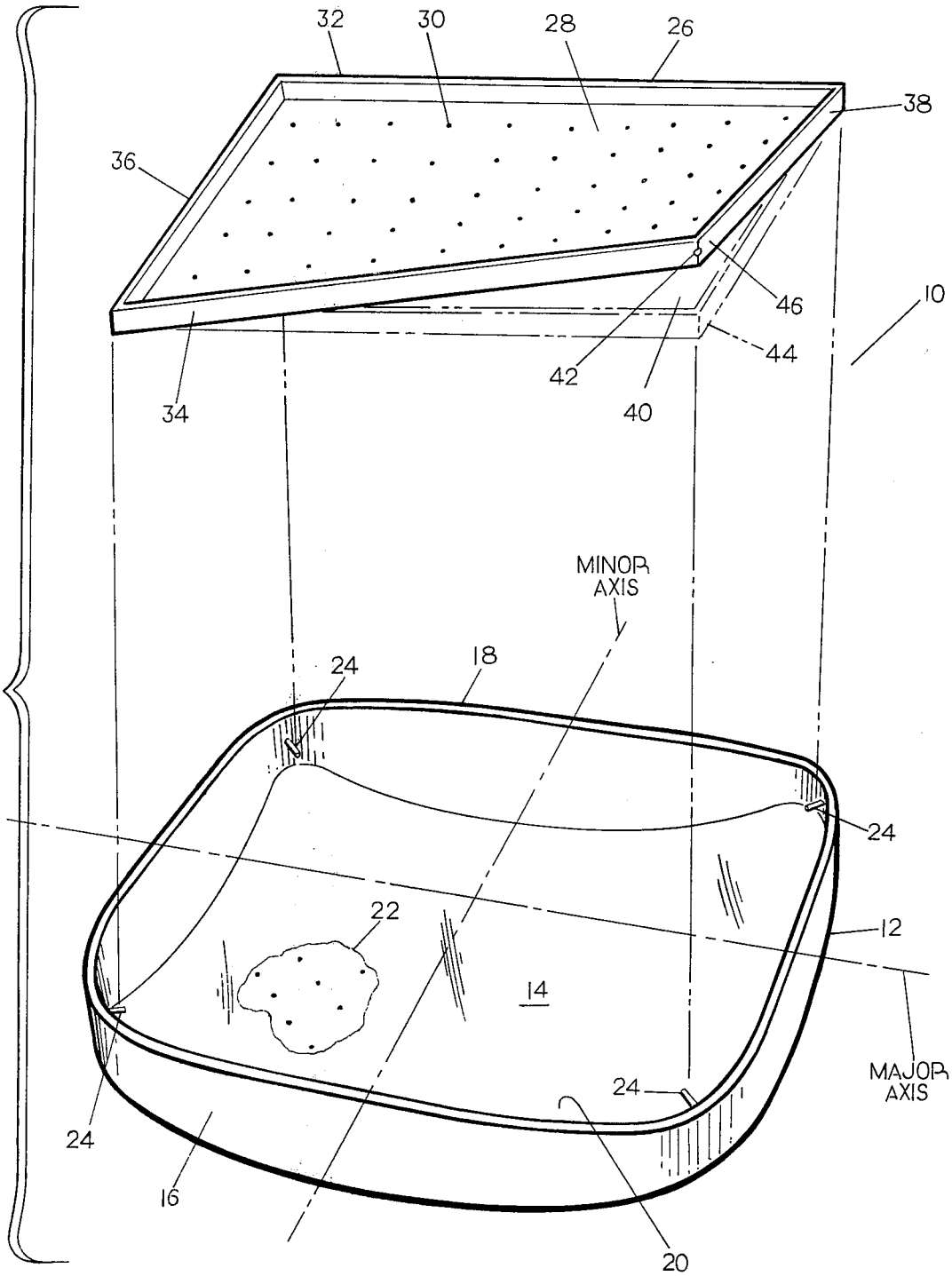
FIG. 1 is a perspective view of a television tube faceplate and its shadow mask.

As shown in the drawing, the general assembly is noted by numeral 10. A glass faceplate 12 is shown at the bottom of FIG. 1. The faceplate 12 consists of a viewing panel 14 and a peripherally attached flange 16. The flange 16 terminates at its most rearward edge 18 which is of planar configuration to facilitate its attachment to the funnel portion (not shown) of the cathode ray tube. The interior surface 20 of faceplate 12 is of approximate spherical configuration and depicts a representative area of the phosphor dots 22 which cover its entire area in the completed television tube.

The corners of flange 16 support rigidly affixed studs 24 which are embedded into the glass structure as heretofore mentioned.

A shadow mask 26 is shown in FIG. 1 immediately above glass faceplate 12. Shadow mask 26 consists of a thin sheet 28 of conductive material such as steel. Sheet 28 contains an array of apertures 30 positioned over its entire surface. The shadow mask assembly is completed by frame members 32 and 34 which are attached to and span the long sides of sheet 28. In a similar manner, sheet 28 has frame members 36 and 38 attached to its short sides. The corners 40 are not rigidly affixed, that is, the intersection of short frame member 36 and long frame member 34 remains flexible in respect to each other although each frame member is firmly attached to sheet 28. Each corner 40 contains an aperture 42 adapted to coact with the studs 24 of the faceplate 12. Provisions can be made in one or more of apertures 42 to permit a slight rotation of the shadow mask 26 without sacrificing any rigidity in the direction along the axis of the tube. One approach to providing rotation of the shadow mask with respect to the mounting studs is to elongate one or more of apertures 42.

Thus it can be realized the shadow mask 26 can be considered as a rectangular four bar linkage attached to a flexible sheet. While a three bar linkage is a basic building block in structures and is inherently rigid, a four bar linkage such as represented by frame members 32, 34, 36 and 38 is not a rigid structure. The structure cannot be skewed into a parallelogram because each frame member is firmly attached to sheet 28, however, there yet remains a degree of freedom of movement within the shadow mask 26 since it can be torsionally twisted about its diagonals as shown in FIG. 1. The dotted representation shown at 44 depicts the position the shadow mask 26 would assume if all frame members were planar. The actual position 46 assumed by this particular corner of shadow mask 26 shows that frame members 34 and 38 have rotated in an upward direction, and as a result, have taken the adjacent portions of sheet 28 therealong since sheet 28 is attached to the entire expanse of frame members 34 and 38. For purposes of illustrating the present invention, it is assumed three of the four corners 40 maintain their contact with a theoretical plane while only one corner assumes a position either above or below the theoretical plane.

Thus the modified four bar linkage as represented by sheet 28 and frame members 32 through 38 is relatively stiff with respect to the major and minor axes of the television tube. The above mentioned axes are so labeled on the lower half of FIG. 1.

With the above provided description of the shadow mask 26 and the glass faceplate 12 to which it couples, a description of how the inherent flexibility of the shadow mask 26 can be utilized will follow.

The "Q" spacing, or the distance between the surfaces of the shadow mask and the surface of the faceplate upon which the phosphors are deposited, is quite important in a colored television tube. Thus it is imperative that the studs 24 be positioned so that the surface of sheet 28 of shadow mask 26 will be substantially equidistant at all points with respect to the phosphor dots 22 of faceplate 12.

It is understood that any three of the four studs 24 of faceplate 12 define a plane. The distance of the fourth stud from the three stud plane will be identified as Z; this distance would be the distance between the dotted representation 44 and the actual position of corner 40 as shown in FIG. 1. The deformation of the shadow mask 26 to be used with the four studded faceplate 12, while holding three studs 24 stationary and moving the fourth vertically, is known and can be developed mathematically into an equation. The development of this equation results from the following algorithm which has been developed with the sketch shown in FIG. 2. The deviation at each point from the theoretical three stud plane can be calculated by first transforming the Cartesian coordinates of each such point to the "natural" coordinate system utilizing the diagonals of the shadow mask 26.

Figure 2:
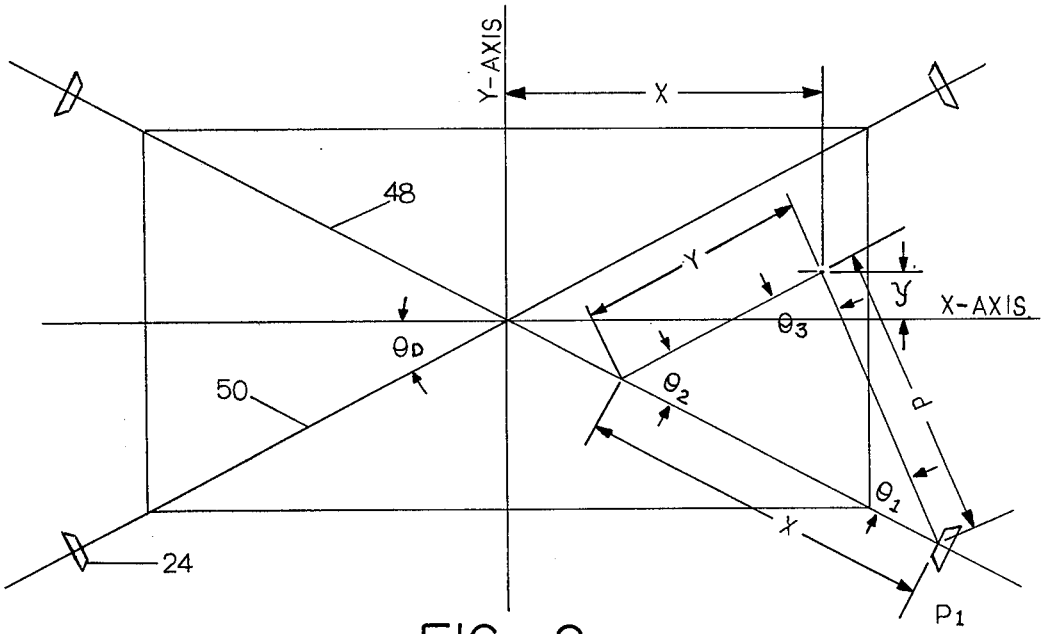
FIG. 2 is a schematic that shows the basic geometry used in the mathematical model.

The primary diagonal 48, as shown in FIG. 2, represents that diagonal which contains the fourth stud shown on FIG. 2 as $P_1$. The remaining diagonal is referenced as the secondary diagonal 50. The Y coordinate is the distance from the point x, y to the primary diagonal 48 measured along a line that is parallel to the secondary diagonal 50. The distance Y is positive for points on the right side of primary diagonal 50 as viewed from Point $P_1$. The X coordinate is the distance from the intersection of the line that passes through point x, y and is parallel to secondary diagonal 50. Since the movable support, or point $P_1$, is external to all points x, y on shadow mask 26, the distance X is always positive.

Thus from the above geometry it becomes evident that:

$$d = \sqrt{(xP_1-x)^2+(yP_1-y)^2}$$

$$\theta_1 = 180\text{-}\theta_D{}^\circ\text{-Tan}^{(1}\left(\frac{yP_1-y}{xP_1-x}\right)$$

$$\theta_2 = 2\theta_D$$

$$\theta_3 = 180^\circ-\theta_1-\theta_2$$

$$Y = -\frac{d\ \text{Sin}\theta_1}{\text{Sin}\theta_2}$$

$$X = -\frac{d\ \text{Sin}\theta_3}{\text{Sin}\theta_2}$$

By knowing the above values for X and Y, they can be coupled with the distance point $P_1$ is positioned above or below the three stud plane. An empirical formula can be developed and expressed as:

$$\Delta Z = A_o/X^{2+A_1}/X + A_2X + A_3X^2 + b_1Y + b_2Y^2 + C$$

In the above equation $A_o$, $A_1$, etc. are functions of the distance the point $P_1$ is above or below the plane determined by the three other studs 24 remote from point $P_1$. An evaluation of the above equation yields the following values:

$A_1 = 123.38Z$ $A_2 = -66.83Z$ $A_3 = 1.74Z$ $b_1 = O$ (because of symmetry about diagonal 48.)

$b_2 = 3.45Z$ $C = 876.01Z$ $A_o = 0.65\ (1000.00Z - 1.24A_1 - 0.81A_2 - 0.65A_3 - C)$

In order to apply the above method to a faceplate and shadow mask combination, a computer need be relied upon to make the calculations in a timely manner. Programs associated with computers are well known and standard in terms of programming and need not be described herein.

Figure 3:
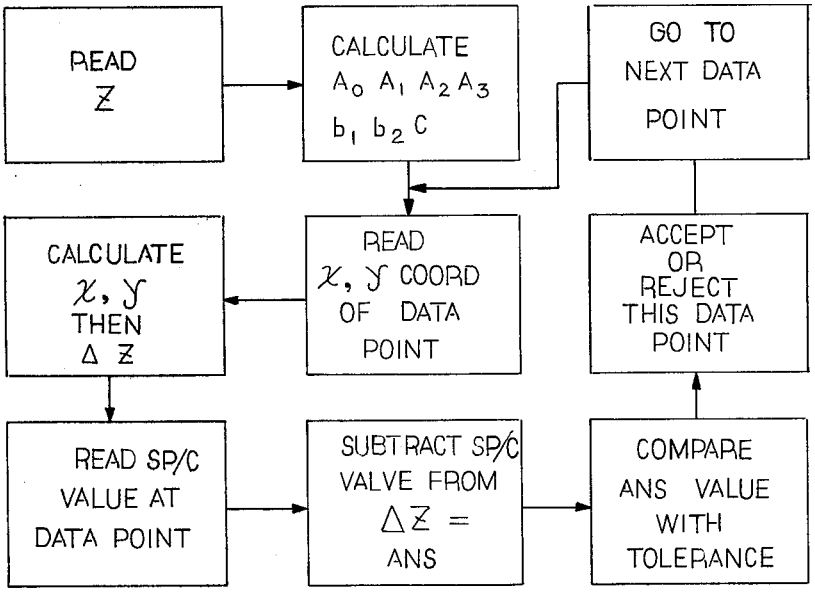
FIG. 3 is a block flow diagram which shows the various method steps.

FIG. 3 is a block diagram that shows the steps employed in the present method. First, the Z readings are obtained by utilizing a bogie shadow mask and situating it in a proper position on three of the studs 24. When the Z readings are obtained, the values $A_0$, $A_1$, $A_2$, $A_3$, $b_1$, $b_2$ and C can be calculated. The x, y coordinates of the particular point under investigation is read. The values X and Y in terms of the primary and secondary diagonals are then calculated as is $\Delta Z$. The actual Stud-Plane-to-Contour (SP/C) values are then measured at the selected point. The SP/C value is then subtracted from the $\Delta Z$ value to provide a working answer. This answer is then compared with the established tolerance. Based upon the difference between the answer and the tolerance, the particular point can be ascertained to be within or outside of the tolerance. A certain select number of points x, y over the faceplate is subjected to a check as set forth above.

The method attributable to the present invention is a distinct aid for in-line inspection. The invention is particularly valuable as an adjunct to the implementation of corrections on the production line. The optimum positioning of the shadow mask studs can be determined with minimal error and in a straightforward manner. In particular, the present method allows an estimation of the Q space error for nonrigid shadow masks before they are fabricated.

To further appreciate the present invention, the following paragraph outlines the manufacturing steps involved in the fabrication of a colored television faceplate. The hot glass is dropped into a mold and through the action of a plunger, the molten glass is pressed to the desired configuration. As soon as the glass has cooled sufficiently to retain its shape, the faceplate is removed from the mold and is placed on a stud insertion machine which utilizes a four point suspension system to position the faceplate in the proper attitude for reception of the studs. After the studs have been embedded into the interior flange wall, the faceplate is then passed through an annealing lehr where residual stress concentrations are removed or relaxed. Immediately upon exiting the annealing lehr, the faceplates are subjected to an inspection procedure heretofore set forth in detail. The inspection permits an immediate correction in the position of one of the studs in the faceplates which are about to receive studs prior to being placed in the annealing lehr. Of course, at the same time the faceplate is inspected for the nonplanar positioning of the studs, the overall orientation of the stud plane with respect to the faceplate must be maintained.

The method set forth above has been described in terms of a CRT faceplate that has an integrally formed flange attached thereto. The same method applies equally well to a faceplate that has no flange as such. With a flangeless faceplate, shadow mask fastening means, such as pins, are installed in the convex side of the glass. In all other aspects, the method of monitoring the variance in distance between a plane established by the selected mounting points and the convex surface of the flangeless faceplate is the same as for a flanged faceplate.

While it is to be understood the present invention can apply to the situation where the fourth stud is placed in the faceplate flange after calculations have been made with respect to the out of plane distance of the shadow mask, the invention primarily is of benefit in adjusting or modifying the position of the fourth stud in faceplates that are about to be manufactured.

What is claimed is:

1. The method of manufacturing a cathode ray tube including the steps of:

(a) forming a glass faceplate to a concave configuration, (b) inserting a plurality of shadow mask support studs, in spaced apart relationship, into the concave side of said faceplate, (c) selecting at least three of said studs to establish a reference plane and indexing a gauging mechanism therewith, (d) measuring the distance of one of said nonselected studs is out of alignment with said reference plane, (e) comparing said measured distance to a mathematical model representing the convex surface of a flexible shadow mask, one section of which has been deflected out of plane equivalent to the out of plane distance of said nonselected stud, (f) calculating the distance between the convex surface of the shadow mask model and the actual concave surface of the faceplate at a plurality of locations, (g) resetting the position of the said non-selected stud tooling so that the distance between the shadow mask and the faceplate is within tolerance at said locations on the next to be manufactured faceplate.

2. The method of manufacturing a cathode ray tube including the steps of:

(a) forming the glass to a concave configuration with a peripheral integrally attached flange, (b) inserting a plurality of shadow mask support studs, in spaced apart relationship, into the interior of the flange structure, (c) selecting at least three of said studs to establish a reference plane and indexing a gauging mechanism therewith, (d) measuring the distance of one of said nonselected studs is out of alignment with said reference plane, (e) comparing said measured distance to a mathematical model representing the convex surface of a flexible shadow mask, one section of which has been deflected out of plane equivalent to the out of plane distance of said nonselected stud, (f) calculating the distance between the convex surface of the shadow mask model and the actual concave surface of the faceplate at a plurality of locations, (g) resetting the position of the said nonselected stud tooling so that the distance between the shadow mask and the faceplate is within tolerance at said locations on the next to be manufactured faceplate.

3. The method of manufacturing a cathode ray tube faceplate for polychromatic television reception, including the steps of:

(a) forming the glass while in the thermoplastic state to a concave configuration with a peripheral integrally attached flange, (b) cooling the faceplate until it can withstand the forces associated with its removal from the forming tooling, (c) inserting at least four shadow mask supporting studs in spaced apart relationship into the interior of the flange structure of the faceplate, (d) attaching a gauge mechanism to at least three of the four studs, thus establishing a reference plane, (e) measuring the distance the fourth stud is out of alignment with the established reference plane, (f) comparing said measured distance to a mathematical model representing the convex surface of a flexible shadow mask, one portion of which has been deflected out of plane equivalent to the out of plane distance of the fourth stud, (g) calculating the distance between the convex surface of the shadow mask model and the actual concave surface of the faceplate at a plurality of locations, (h) resetting the positioning of the fourth stud tooling so that said distance is within tolerance at said locations on the next to be manufactured faceplate.

4. The method of manufacturing a cathode ray tube faceplate for polychromatic television reception, including the steps of:

(a) pressing the glass while in the thermoplastic state to a concave configuration viewing surface with a peripheral integrally attached flange, (b) cooling the faceplate until it can withstand the forces associated with its removal from the mold, (c) inserting at least four shadow mask supporting studs, in spaced apart relationship, into the interior of the flange structure prior to the cooling of the faceplate to ambient temperature, (d) annealing the faceplate and its accompanying studs by passing the faceplate through a lehr, (e) attaching a gauge mechanism to three of the four studs, thus defining a reference plane, (f) measuring the distance the fourth stud is out of alignment with the established reference plane, (g) comparing said measured distance to a mathematical model representing the convex surface of a flexible shadow mask, one portion of which has been deflected out of plane equivalent to the out of plane distance of the fourth stud, (h) calculating the distance between the convex surface of the shadow mask model and the actual concave surface of the faceplate of a plurality of locations, (i) resetting the positioning of the fourth stud tooling so that said distance is within tolerance at said locations on the next to be manufactured faceplate.

5. The method of claim 4 wherein the viewing surface of faceplate is of generally rectangular configuration.

6. The method of claim 5 wherein the studs are positioned in the corners of the faceplate flange.

7. The method of claim 6 wherein the interior surface of the faceplate is of spherical configuration.

8. The method of claim 7 wherein the exterior surface of the shadow mask is of spherical configuration.

9. The method of manufacturing a cathode ray tube faceplate for polychromatic television reception, including the steps of:

(a) pressing the glass while in the thermoplastic state to a concave configuration viewing surface with a peripheral integrally attached flange, (b) cooling the faceplate until it can withstand the forces associated with its removal from the mold, (c) inserting three shadow mask supporting studs, in spaced apart relationship, into the interior of the flange structure prior to the cooling of the faceplate to ambient temperature, (d) annealing the faceplate and its accompanying studs by passing the faceplate through a lehr, (e) attaching a gauge mechanism to said three studs, thus defining a reference plane, (f) comparing a fourth in plane stud position with a mathematical model representing the convex surface of a flexible shadow mask, one portion of which has been deflected out of plane to match the contour of said faceplate interior surface and to determine the optimum position of a fourth stud, (g) based on the comparing step positioning a fourth stud in the faceplate at a position outside of said reference plane.

10. The method of claim 9 wherein the studs are positioned in the corners of the faceplate flange.

11. The method of claim 10 wherein the interior of the faceplate is of spherical configuration.

* * * * *